United States Patent [19]

Tsai

[11] Patent Number: 4,996,733

[45] Date of Patent: Mar. 5, 1991

[54] AIR MATTRESS REINFORCED SLEEPING BAG WITH HEAD COVERING

[76] Inventor: Ying-Lang Tsai, P.O. Box 10780, Taipei, Taiwan

[21] Appl. No.: 509,762

[22] Filed: Apr. 17, 1990

[51] Int. Cl.[5] ..... A47G 9/08

[52] U.S. Cl. ..... 5/413; 5/418; 5/414

[58] Field of Search ..... 5/413, 414, 418, 113, 5/512, 415, 416, 441; 2/69.5

[56] References Cited

U.S. PATENT DOCUMENTS

| | | | |
|---|---|---|---|
| 1,324,009 | 12/1919 | Hope | 5/413 |
| 1,805,415 | 5/1931 | Pendarvis et al. | 5/413 |
| 2,413,828 | 1/1947 | Hirsh et al. | 5/414 |
| 2,594,438 | 4/1952 | Howe | 5/413 |
| 3,717,888 | 2/1973 | Phelan | 5/416 |

FOREIGN PATENT DOCUMENTS

| | | |
|---|---|---|
| 207621 | 2/1940 | Switzerland . |
| 648452 | 1/1951 | United Kingdom . |

*Primary Examiner*—Alexander Grosz

*Attorney, Agent, or Firm*—Pollock, Vande Sande & Priddy

[57] ABSTRACT

A reinforced air mattress sleeping bag includes an air mattress unit with upper and bottom mattresses, a head rest piece and a head covering. The head rest piece can be formed by extending the bottom air mattress at a distance suitable for accommodating the user's head, or can be formed separately to be connectable to the mattress by a fastening device. The upper and bottom mattresses of the air mattress unit, when inflated, can prevent the inner sleeping bag received therebetween from dampness, and the head rest piece provided with the head covering prevents the user from mosquitos and other insects.

11 Claims, 4 Drawing Sheets

AIR MATTRESS REINFORCED SLEEPING BAG WITH HEAD COVERING

BACKGROUND OF THE INVENTION

With increasing interest in different outdoor activities, camping has become more popular in recent years. Among the various equipment needed, a camper should have a sleeping bag as an indispensable item.

Conventional sleeping bags generally have a waterproof layer to provide protection against dampness. However, the outdoor cold and humid air, as well as the morning dew, may still considerably dampen the sleeping bag after an overnight sleep. Also, conventional sleeping bags do not include any head covering which would protect a camper sleeping outdoors from mosquitos or other insects.

Moreover, in case of a rough camping site, a conventional sleeping bag without an air mattress or foam mat would not be soft enough for the camper to get a good night's sleep. Accordingly, it appears that the conventional sleeping bag, though with a warming effect, still has many disadvantages.

In order to eliminate the above disadvantages, the applicant conducted experiments and studies which resulted in the present invention sleeping bag.

SUMMARY OF THE INVENTION

The object of the present invention is to provide a reinforced air mattress sleeping bag to be used for sleeping outdoors without being dampened by the humid air and morning dew.

It is another object of the present invention to provide a reinforced air mattress sleeping bag with a head covering to protect the user from insects.

It is a further object of the present invention to provide a reinforced air mattress sleeping bag which is warm and comfortable.

It is still a further object of the present invention to provide a reinforced air mattress sleeping bag which is easy and convenient for carrying.

The present invention air mattress sleeping bag includes an air mattress unit formed by a plurality of air chambers defining an upper air mattress and bottom air mattress, which is further provided with a head covering attached to the air mattress unit by a fastening device. The waterproof effect of the present invention is provided by inserting a sleeping bag in between the upper air mattress and the bottom air mattress so as to efficiently insulate the sleeping bag, when the mattresses have been inflated, from moisture and dew. Furthermore, a movable mask is pivotably mounted on the head covering to protect the user's head from insects The head covering, and also preferably the movable mask, are provided with a plurality of ventilators covered with netting wire or mesh to enable the circulation of air without letting in the insects. As it can be easily seen, the present invention serves not only as a warm and comfortable sleeping bag, but also an air mattress and a mosquito net.

The present invention will now be described in more detail in the following description of the preferred embodiments with reference being made to the accompanying drawings which are provided merely for reference and illustration and should not be treated as limitations of the present invention.

In the drawings:

DETAILED DESCRIPTION OF THE PREFERRED EMBODIMENT(S)

Figures 1, 5:
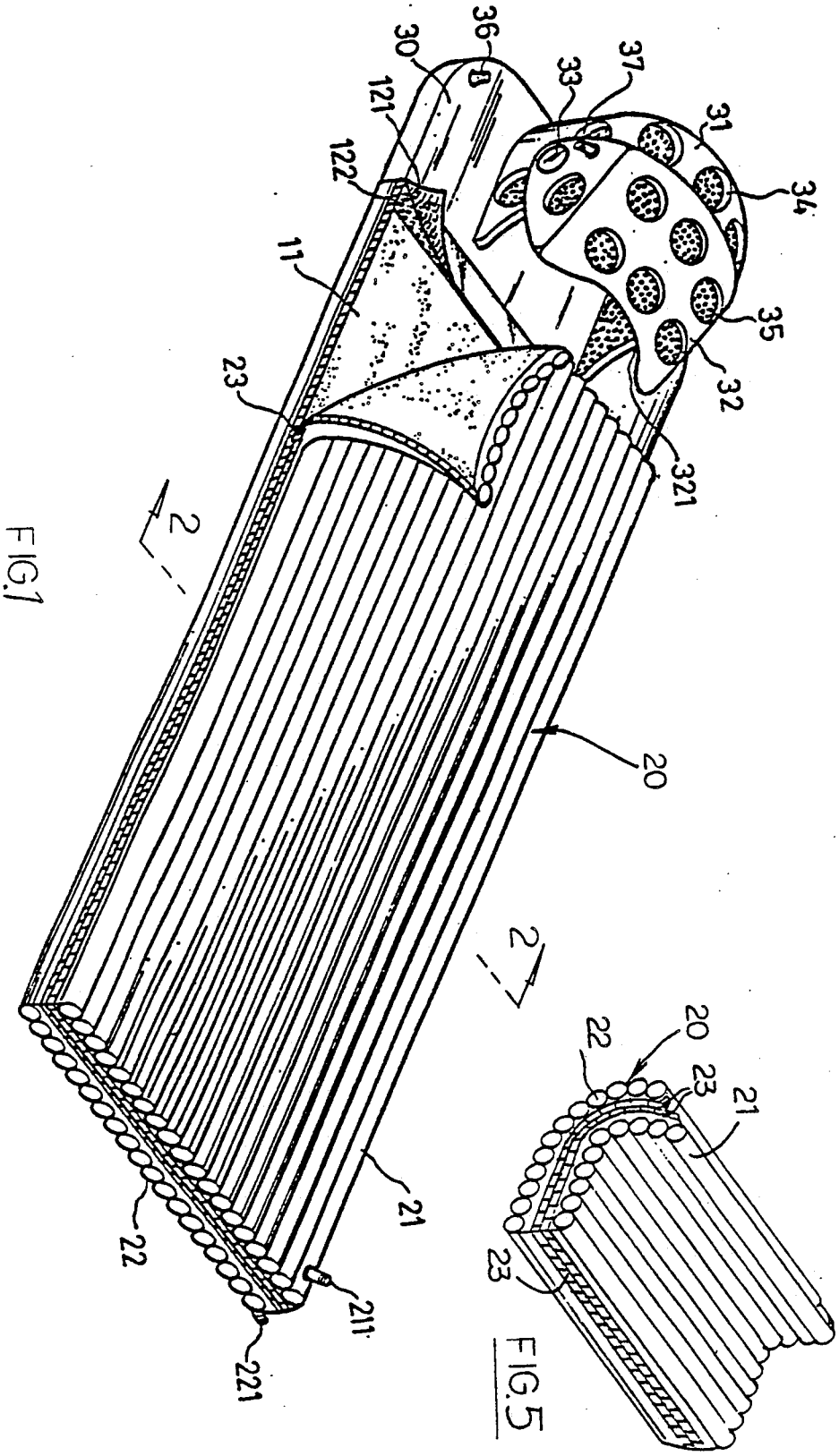
FIG. 1 is a perspective view of a reinforced air mattress sleeping bag according to the present invention.
FIG. 5 is a partial perspective view of a second embodiment of the present invention.
Figure 2:
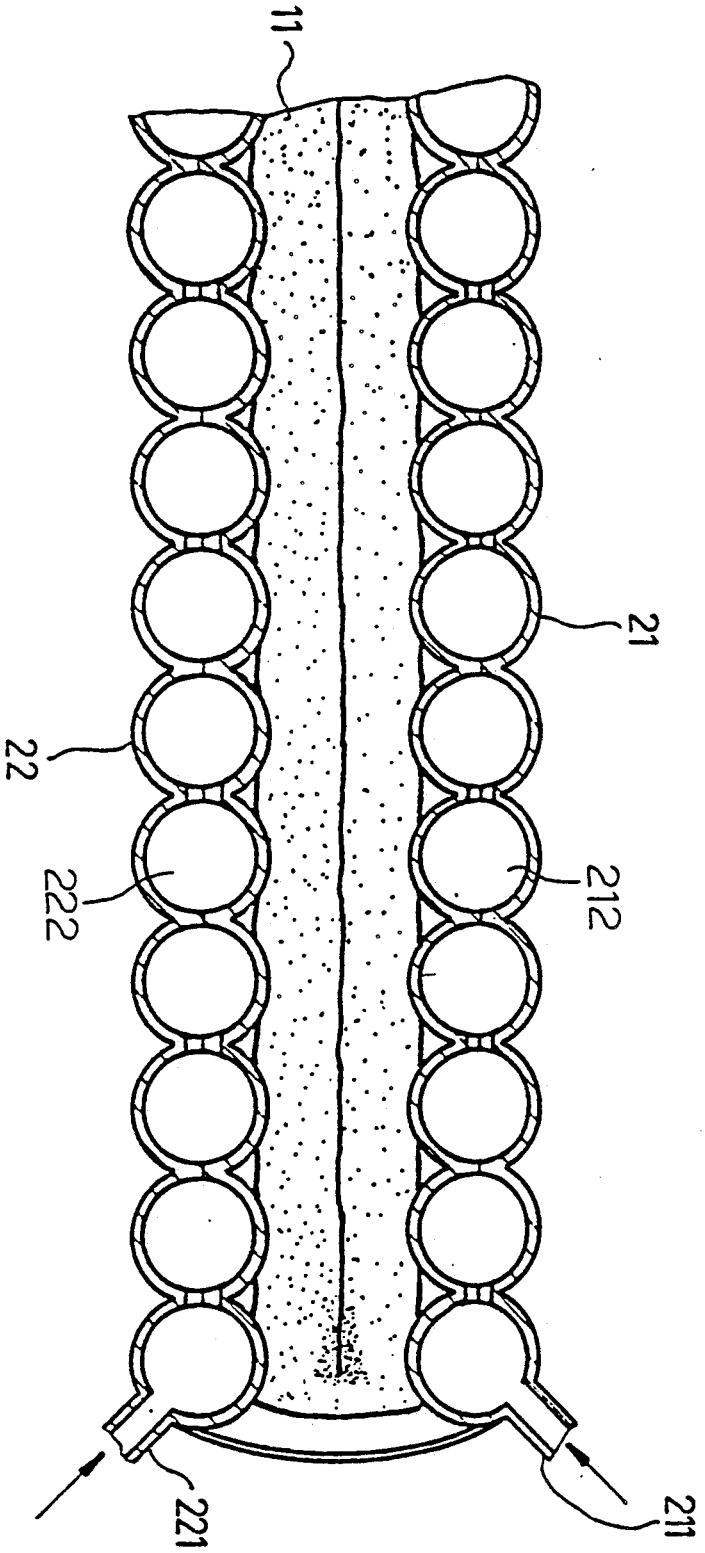
FIG. 2 is an enlarged cross-sectional view of the present invention taken along line 2—2 in FIG. 1.
Figure 3:
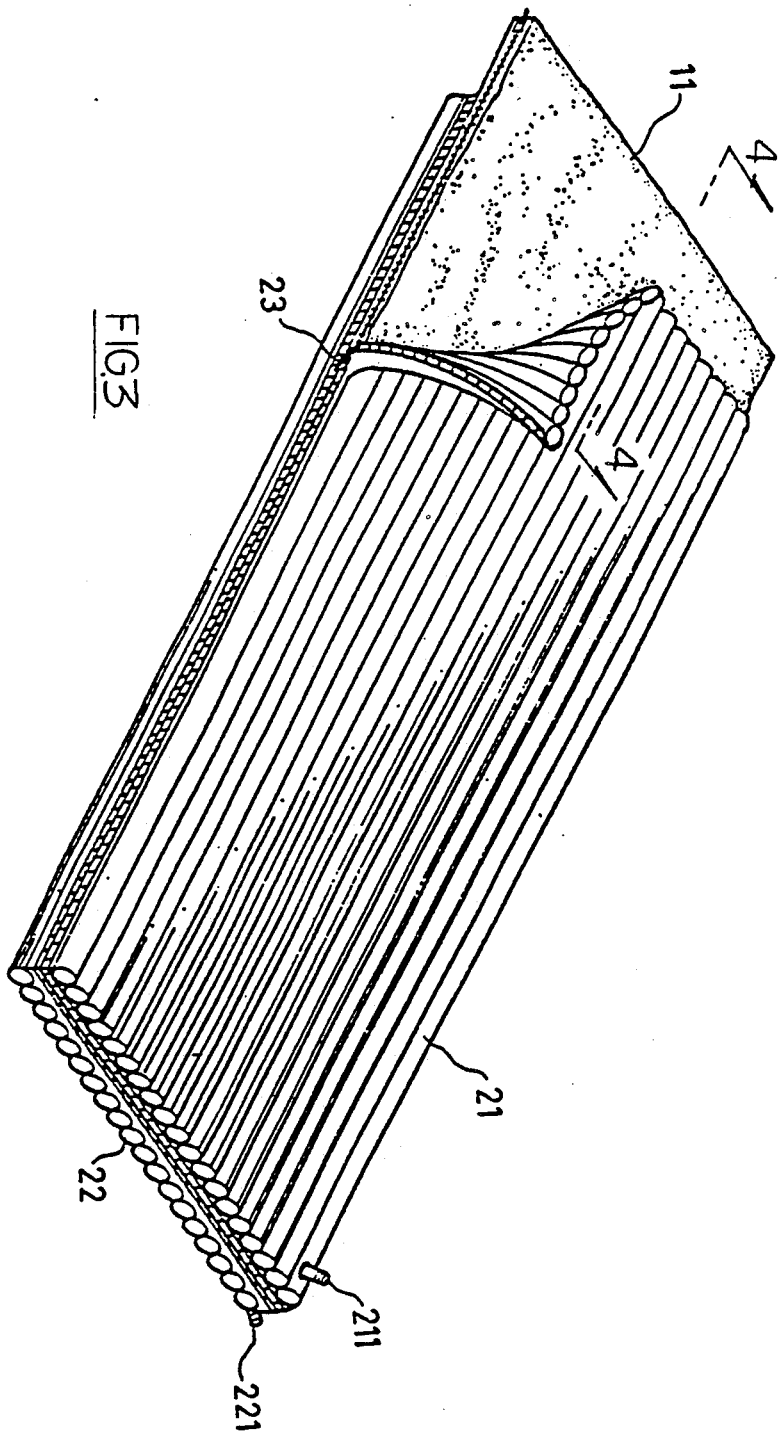
FIG. 3 is a partial perspective view of the present invention showing the inner sleeping bag.
Figure 4:
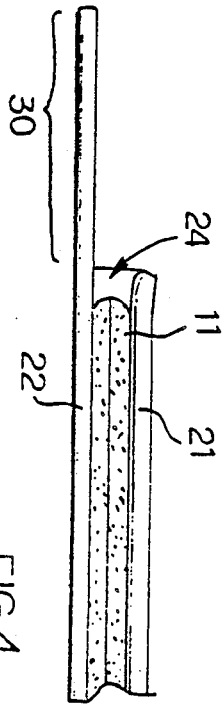
FIG. 4 is a partly longitudinal sectional view taken along line 4—4 of FIG. 3.
Figure 6:
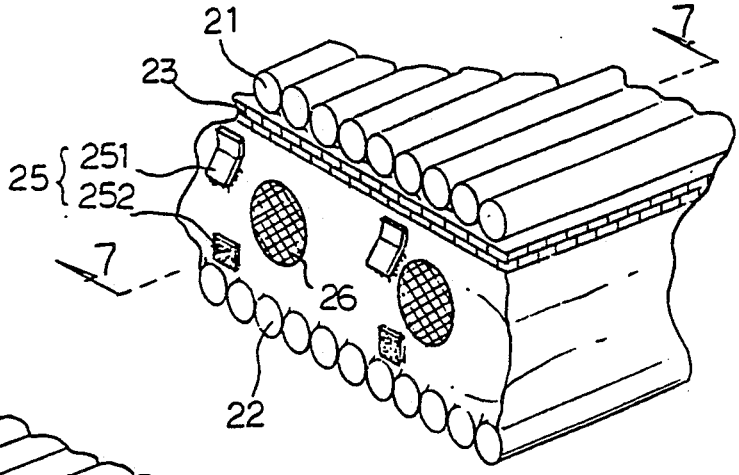
FIG. 6 is a partial perspective view of a third embodiment of the present invention.

A reinforced air mattress sleeping bag of the present invention as shown in FIG. 1 comprises an air mattress unit 20 having an upper air mattress 21 and a bottom air mattress 22 which are formed by a plurality of air chambers 212 and 222, as shown in FIG. 2, that are not airtight to one another. The air chambers can be defined by a number of parallel air strips wherein the air can be sent through to one another. FIG. 4 illustrates a configuration made by traversal air strips to enable the air mattress unit to be easily folded. The air mattress unit is provided with at least one air cock 211 or 221 to inflate the upper air mattress and bottom air mattress therethrough.

The rims of the upper and bottom mattresses are connected by a releasable side fastener 23, for example a zipper, but at least one side of the connected rims is left open as an opening 24 illustrated in FIG. 4. The bottom air mattress can be extended beyond the rims forming the opening at a distance suitable to form a head rest piece 30 for the user's head, and a warm sleeping bag 11 can be received between the upper and bottom air mattresses to form together therewith a comfortable and waterproof sleeping bag.

The head rest piece 30 described herein can be an inflatable piece extended from the bottom air mattress as shown in FIG. 4, or alternatively, a separate, inflatable piece as shown in FIG. 1 which is provided at one end with a female part 121 of a fastening device connectable to a corresponding male part 122 of the fastening device at the end of the bottom air mattress 22. The attachment of the head rest piece 30 to the bottom air mattress 22 can be made in various ways, for example, by using a zipper or buttons.

To protect the user's head from mosquitos or other insects, a head covering 31 is formed on the top of the head rest piece 30. To facilitate insertion of the user's head into the head covering 31, a movable mask 32 is provided which is pivotably mounted on the head covering 31 by two side pins 33. A number of ventilators 34 covered with netting wire 35 are formed on both the head covering and the movable mask to enable the circulation of the air while keeping out the insects Moreover, the head covering and movable mask can be formed as an inflatable piece to be inflated by an air cock 37, similarly as the head rest piece which can be inflated by an air cock 36, so that they can be easily applied and stored. In an alternative embodiment, the head covering can be made as a single piece without a movable mask 32, the entire head covering then being provided with meshed vent holes.

Figure 9:
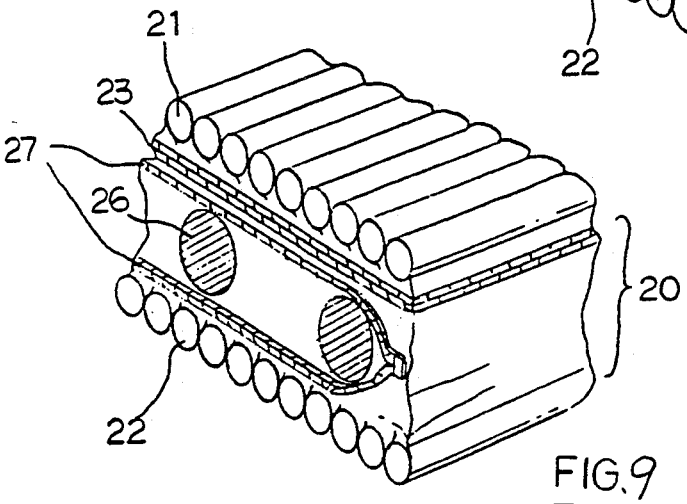
FIG. 9 is a partly perspective view of a fourth embodiment of the present invention.
Figure 7:
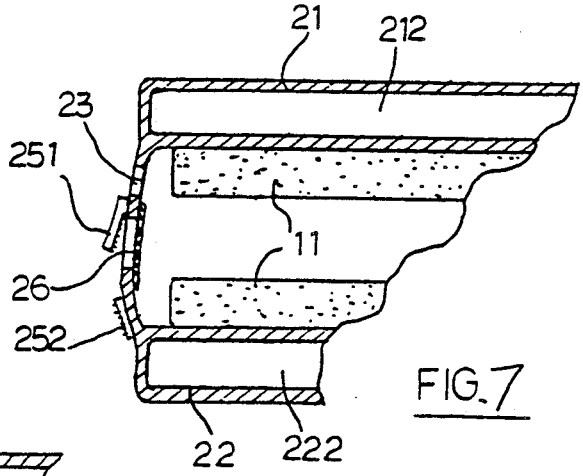
FIG. 7 is a partly cross-sectional view taken along line 7—7 from FIG. 6.
Figure 8:
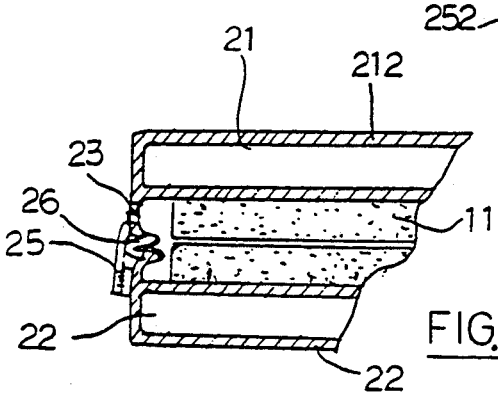
FIG. 8 is similar to FIG. 7 showing closing of the vent holes.

Another embodiment illustrated in FIGS. 6, 7, 8 and 9 is designed to provide more sleeping comfort to the user. It can be seen from the figures that, from at least one side of the rim of the bottom air mattress, a side wall is extended upwards and is provided with meshed ventilators 26. The top edge of the side wall is then connected with the rim of the upper air mattress 21 by a side fastener. A closing means, shown in FIG. 6, 7 and 8 as a fastening device 25, is provided to partly or wholly close the meshed ventilators. A male fastening element 251 is affixed above each ventilator and a corresponding female fastening element 252 is affixed beneath each ventilator. Furthermore, a zipper 27 can be provided, as shown in FIG. 9, to close all the ventilators.

In summary, the present invention sleeping bag structure preferably includes an air mattress unit 20 having an upper air mattress 21 and a bottom air mattress 22 connected by a releasable side fastener 23 and a warm sleep bag 11 provided therebetween; a head rest piece 30 inflatable by an air cock 36 to form a inflated, comfortable head rest; and a head covering 31 which can be attached on the top of the head rest piece 31 and has pivotably mounted thereon a movable mask 32 having a curved groove 321 at its end to close the entire head covering 31 and form a closed space by fitting the curved groove 321 around the user's neck. Moreover, with the design including the meshed vent holes on the head covering, the movable mask and the side wall formed by the extension of the bottom air mattress, air can circulate well and the insects are efficiently kept out of the head covering.

Accordingly, the present invention provides a novel, inflatable sleeping bag including an attachable head rest piece which can be easily folded, stored and applied, and with a head covering provided with meshed vent holes.

As described hereinabove, it can be easily seen by those skilled in the art that various modifications of the configuration of the present invention can be embodied in accordance with the substantial ideas of this invention and therefore shall be deemed as defined in the claims set forth hereinafter. It is not expected to be limited by the drawings which illustrate merely the preferred examples of the present invention.

I claim:

1. A reinforced air mattress sleeping bag, comprising:

an inflatable air mattress unit provided with a plurality of air chambers which are not airtight to each other, said air mattress unit including an upper air mattress and a bottom air mattress which are connectable together along their rims in such a manner that at least one side of the connected mattresses is open and forms a recess opening;

a warming sleeping bag inserted in between said upper and bottom air mattresses of the air mattress unit;

a head rest member extending from said bottom air mattress beyond said recess opening at a distance suitable to accommodate a user's head, said head rest member being formed by at least one inflatable air chamber; and an inflatable head covering member adapted to fit over the user's head which is mounted on said head rest member, said head covering member having a plurality of air permeable means provided therein for allowing air circulation into said head covering member while preventing insects from entering into said head covering member said head covering member further including a movable mask pivotally mounted thereon.

2. A reinforced air mattress sleeping bag according to claim 1, wherein said head rest member is a separate, inflatable piece provided at one end with a fastening device for attaching to a corresponding fastening device provided at the end of said bottom air mattress on the side of said opening.

3. A reinforced air mattress sleeping bag according to claim 1, wherein said bottom air mattress and said head rest member are made as a single unit.

4. A reinforced air mattress sleeping bag according to claim 1, wherein said movable mask is also inflatable.

5. A reinforced air mattress sleeping bag according to claim 4, wherein said mask is also provided with said air permeable means.

6. A reinforced air mattress sleeping bag according to claim 1, wherein said rims of the upper and bottom air mattresses, along at least one side of said mattresses, are connectable by a releasable side fastener.

7. A reinforced air mattress sleeping bag according to claim 6, wherein said releasable side fastener is a zipper.

8. A reinforced air mattress sleeping bag according to claim 1, wherein said air permeable means includes a plurality of vent holes covered with mesh or netting wire.

9. A reinforced air mattress sleeping bag according to claim 1, wherein said air chambers of the air mattress unit are formed by a plurality of parallel air strips which are not airtight to one another.

10. A reinforced air mattress sleeping bag according to claim 1, wherein at least one side of said connected upper and bottom air mattresses is provided with meshed vent holes.

11. A reinforced air mattress sleeping bag according to claim 1, wherein a closing means is provided at said side of said connected mattresses to close said meshed vent holes.

* * * * *